US005996262A

United States Patent [19]

Kim

[11] Patent Number: 5,996,262

[45] Date of Patent: Dec. 7, 1999

[54] BIMETALLIC COIN AND METHOD FOR PRODUCING THE SAME

[75] Inventor: Won Hone Kim, Kyungsangnam-do, Rep. of Korea

[73] Assignee: Poongsan Corporation, Incheon Kwangyeok-si, Rep. of Korea

[21] Appl. No.: 08/821,183

[22] Filed: Mar. 19, 1997

Related U.S. Application Data

[63] Continuation of application No. 08/420,592, Apr. 12, 1995, abandoned.

[30] Foreign Application Priority Data

Apr. 18, 1994 [KR] Rep. of Korea ..... 94-8129

[51] Int. Cl.[6] ..... A47C 21/00

[52] U.S. Cl. ..... 40/27.5; 428/64

[58] Field of Search ..... 40/27.5; 428/64, 428/66

[56] References Cited

U.S. PATENT DOCUMENTS 4,472,891 9/1984 Ielpo ..... 40/27.5

FOREIGN PATENT DOCUMENTS 1317746 10/1987 Canada ..... 40/27.5
0 080 437 6/1983 European Pat. Off. .
0415892 A1 8/1990 European Pat. Off. ..... 40/27.5
529349 3/1993 European Pat. Off. ..... 40/27.5
6-269308 8/1994 Japan ..... 40/27.5

*Primary Examiner*—Cassandra H. Davis
*Attorney, Agent, or Firm*—Jacobson, Price, Holman & Stern, PLLC

[57] ABSTRACT

Bimetallic coin or a medal and a method for producing the same, which is easy to form a ring and an insert composing the coin or the medal, yet costs low, and can assure a higher joining force between the ring and the insert.

The method includes processes for forming a ring by subjecting a first metal to blanking, annealing, and pickling, forming an insert thicker than the ring by subjecting a second metal to blanking and annealing, forming a thickened rim on each side, and an annular ridge around the circumferential surface of the insert, and pickling the insert, and joining the ring and the insert by causing plastic metal flow of the ridge of the insert into the inner circumferential surface of the ring through pressing the insert inserted in the center of the ring; and a bimetallic coin formed with the method.

1 Claim, 7 Drawing Sheets

BIMETALLIC COIN AND METHOD FOR PRODUCING THE SAME

This is a continuation application of Ser. No. 08/420,592, filed on Apr. 12, 1995, abandoned.

This invention relates to products, such as bimetallic coins and medals, and a method for producing the products.

In general, a bimetallic coin or medal, formed by joining two pieces of metals of different material for preventing falsification and for producing high quality products, includes an annular ring and an insert inserted in the center of the ring.

Though the bimetallic coin is a product produced by joining two different metals, it should be inseparable even though a substantial impact is applied on the coin during the use.

Prior art methods for forming the bimetallic coin or the medal, such as European patent publication No.0415892 have disclosed an art that the ring having spaced grooves centrally formed around the inner circumferential surface thereof and the insert having spaced ridges centrally formed around the outer circumferential surface thereof in conformity with the grooves but in opposite direction, are joined together by plastic metal flow of the ridges into the corresponding grooves following compression of both the ring and the insert inserted in the ring at minting the coin.

And European patent No.0080437 has disclosed an art that the ring having an annular ridge centrally formed around the inner circumferential surface thereof and the insert in a simple disc form are joined together by causing a plastic metal flow of the insert to surround the annular ridge following compression of the insert inserted in the ring at minting the coin.

However, all of the foregoing methods requires costly and difficult forming processes due to the formation of the grooves or the ridges at the inner circumferential surface of the ring, and can not be carried out without an exclusive equipment for forming the inner circumferential surface of the ring.

Moreover, forming the grooves or the ridges at the inner circumferential surface of a small diametered coin or medal is not commercially viable.

Different from the above prior arts, Canadian patent No.1,317,746 has disclosed an art that the ring nothing formed thereon but thicker than the insert is joined with the insert having spaced grooves centrally formed around the circumferential surface thereof by plastic metal flow of the ring into the spaced grooves of the insert at minting the coin.

However, the metal flow of the art is opposite to the natural metal flow developing at minting the coin.

That is, the natural metal flow developing in the ring at the minting is in an outward direction expanding both the inner and the outer diameters of the ring, and the natural metal flow developing in the insert at the minting is also in an outward direction reducing the width of the grooves because the grooves have been centrally formed around the circumferential surface of the insert.

Therefore, in case a bimetallic coin or medal is to be formed with the art, since the ring has to be put under a restraint at around the outer circumferential surface thereof at the minting to force the plastically deformed surplus metal of the ring(squeezed out metal of the ring by compression at minting) to flow into the grooves of the insert, the art has a problem that a high pressure should be applied for the inward metal flow of the ring and, consequently, the joining force between the ring and the insert is reduced.

SUMMARY OF THE INVENTION

The object of this invention is to provide a bimetallic coin and a method for forming the same, which is easy to form but costs low, and can assure a sufficient joining force between a ring and an insert.

This object and features of this invention can be achieved by providing a method for forming a bimetallic coin including processes for forming a ring by subjecting a first metal to blanking, annealing, and pickling, forming an insert thicker than the ring by subjecting a second metal to blanking and annealing, forming a thickened rim on each side, and an annular ridge around the circumferential surface of the insert, and pickling the insert, and joining the ring and the insert by causing plastic metal flow of the ridge of the insert into the inner circumferential surface of the ring by pressing the insert inserted in the center of the ring; and by providing a bimetallic coin with the method.

DETAILED DESCRIPTION OF THE INVENTION

Shown in FIGS. 1 to 4 are an insert and a ring formed in accordance with this invention.

By forming a central annular ridge 3 around the circumferential surface of the insert 2 after forming the insert by blanking and annealing, causing the ridge 3 hardened by work hardening, and by inducing a natural metal flow in joining the ring 1 and the insert 2, the joining force between the ring and the insert can be enhanced. Accordingly, this invention, joining the ring and the insert by inducing natural metal flow, can assure a wider joint area as well as an improved joining force compared to the prior art(the Canadian patent), joining the ring and the insert opposite to the natural metal flow.

And, the surplus metal of the thickened rim on each side of the insert flows into, and fills the gap between the ring and the insert at minting, making the appearance of the coin neat.

The thickness of the insert 2 should be thicker than the ring 1 by 1–3%. If it is less than 1%, the gap can not be filled neatly with the small amount of surplus metal, and if it is over 3%, the gap is overflown.

And the central annular ridge 3 formed around the circumferential surface of the insert 2 has a height of 0.05—0.25 mm from the surface of the circumference and a width of 20–50% of the initial thickness of the insert.

If the height and/or the width of the ridge 3 are too small, the joining force between the ring and the insert becomes low, and if they are formed too big, the formation becomes difficult and the appearance becomes not neat.

And, in order to fill the gap neatly, the height of the rim on each side of the insert 2 should be 105–130% of the initial thickness of the insert 2.

This invention is to be explained based on embodiments of this invention, hereinafter.

FIRST EMBODIMENT

The ring(Cu:75% and Ni:25%) formed through blanking, annealing, and pickling to have a thickness of 1.86 mm, an outside diameter of 22.83 mm, and an inside diameter of 16.80 mm and the insert(Cu:92%, Ni:2%, and Al:6%) with the rims and the ridge thereon formed through blanking, annealing, and pickling to have a thickness of 1.92 mm and a diameter of 16.68 mm, have been joined together, and a desired design has been minted thereon.

The insert has been formed to have the ridge 3 on the circumference thereof with a height of 0.17 mm and a width of 0.61 mm, and the rim on each side thereof with a height of 2.13 mm.

Figure 1:
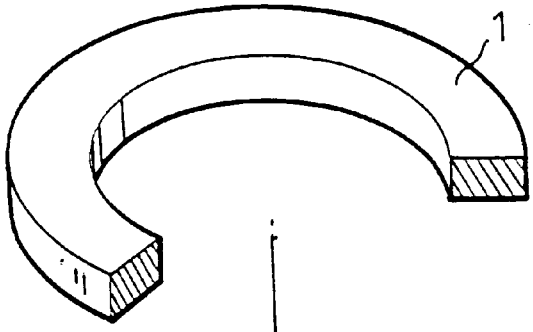
FIG. 1 is a perspective view of a ring in accordance with this invention.
Figure 2:
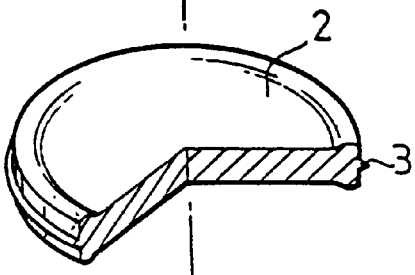
FIG. 2 is a perspective view of an insert in accordance with this invention.
Figure 3:
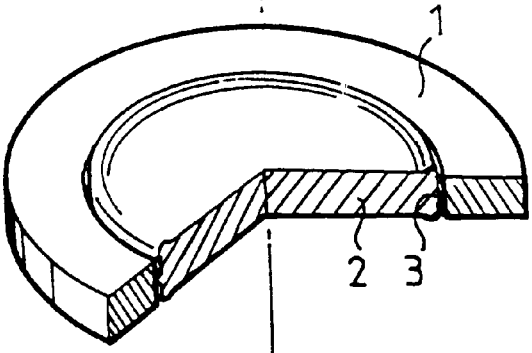
FIG. 3 is a perspective view showing the insert of FIG. 2 has been inserted in the ring of FIG. 1 in accordance with this invention.
Figure 4:
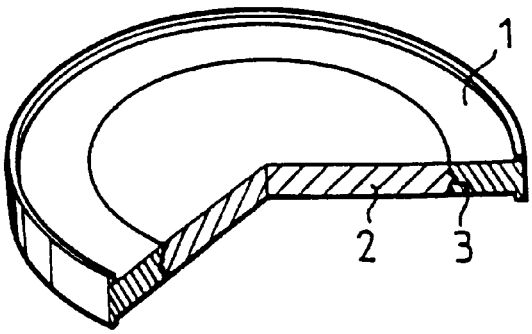
FIG. 4 is a perspective view of a bimetallic coin formed in accordance with this invention.
Figure 5:
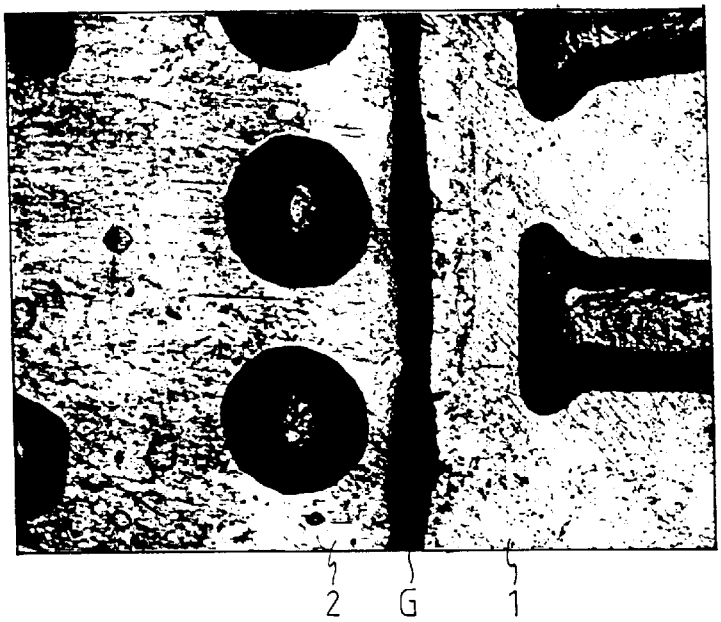
FIG. 5 is a photograph showing a plane view of a gap at a join of a bimetallic coin formed in accordance with a first embodiment of this invention.
Figure 6:
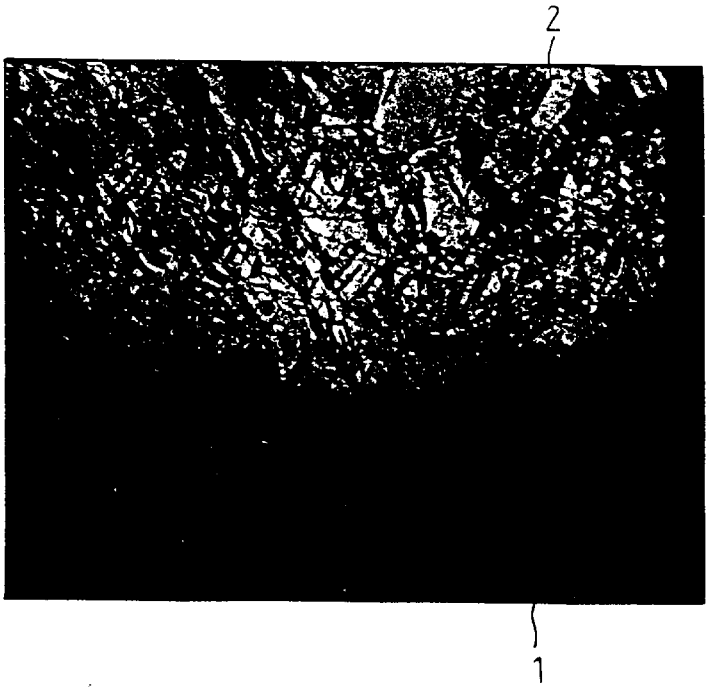
FIG. 6 is a photograph showing a sectional view of a join of a bimetallic coin formed in accordance with the first embodiment of this invention.

Shown in FIGS. 5 and 6 are microscopic photographs of the bimetallic coin formed in accordance with one embodiment of this invention, wherein FIG. 6 is a sectional view of a joint of the bimetallic coin formed by the joining the ring 1 and the insert 2 and FIG. 5 is an enlarged view of FIG. 6 showing a gap G at a joint of the ring and the insert.

Bimetallic coins formed in accordance with one embodiment of this invention and the prior art(the European patent:see FIGS. 7 and 8) are compared as shown in TABLE 1 below.

TABLE 1

Figure 7:
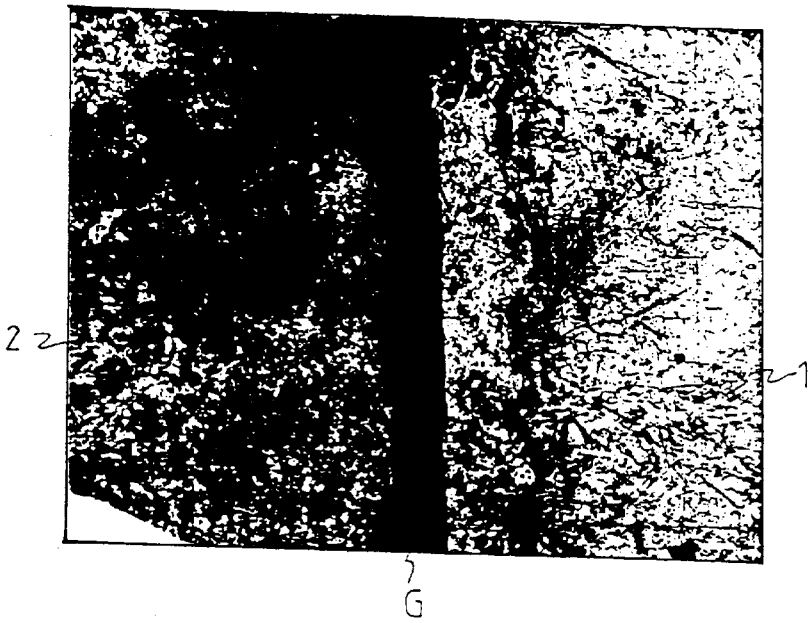
FIG. 7 prior art
FIG. 7 is a photograph showing a plane view of a gap at a joint of a prior art bimetallic coin comparable to that of the first embodiment of this invention.
Figure 8:
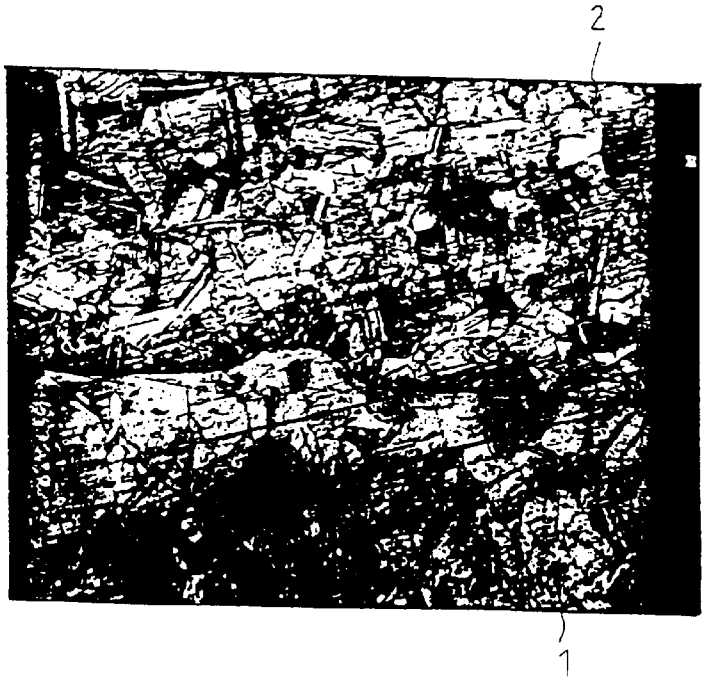
FIG. 8 prior art
FIG. 8 is a photograph showing a sectional view of a gap at a joint of a prior art bimetallic coin comparable to that of the first embodiment of this invention.

| | RESULTS | |
|---|---|---|
| | THIS INVENTION | PRIOR ART |
| outside diameters mm | 23.00 | 23.01 |
| inside diameters mm | 16.98 | 16.73 |
| thicknesses mm | 2.14 | 2.15 |
| joining forces kg · f | 314 | 266 (Canadian patent) |
| gap at the joint mm | 0.03–0.05 (FIG. 5) | 0.05–0.65 (European patent: FIG. 7) |

As can be seen from above table, it is found that this invention has the joining force higher than the Canadian patent by 48 kg·f, and the gap at the joint narrower than the European patent by 0.02 mm–0.60 mm.

SECOND EMBODIMENT

Figure 9:
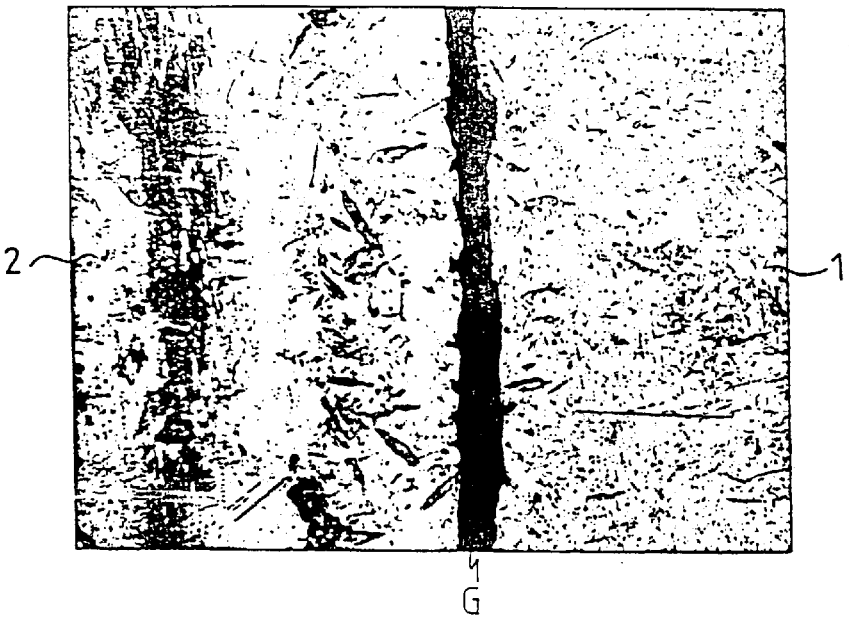
FIG. 9 is a photograph showing a plane view of a gap at a joint of a bimetallic coin formed in accordance with a second embodiment of this invention.
Figure 10:
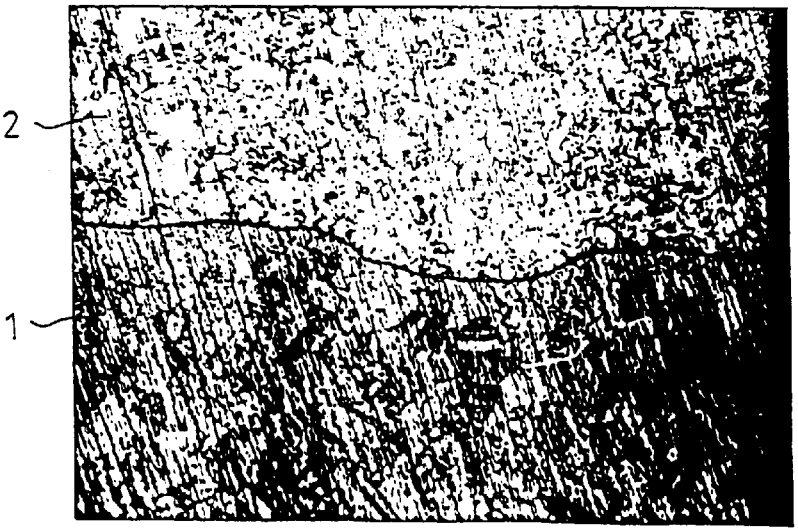
FIG. 10 is a photograph showing a sectional view of a joint of a bimetallic coin formed in accordance with the second embodiment of this invention.

The ring formed through blanking, annealing, and pickling to have a thickness of 1.93 mm, an outside diameter of 25.83 mm, and an inside diameter of 18.40 mm and the insert with the rims and the ridge thereon formed through blanking, annealing, and pickling to have a thickness of 1.95 mm and a diameter of 18.35 mm, have been joined together, and a desired design has been imprinted thereon (FIGS. 9 and 10).

The insert has been formed to have the ridge 3 on the circumference thereof with a height of 0.2 mm and a width of 0.7 mm, and the rims on each side thereof with a height of 2.25 mm.

Bimetallic coins formed in accordance with other embodiment of this invention and the prior art(the European patent:see FIGS. 11 and 12) are compared as shown in TABLE 2 below.

TABLE 2

Figure 11:
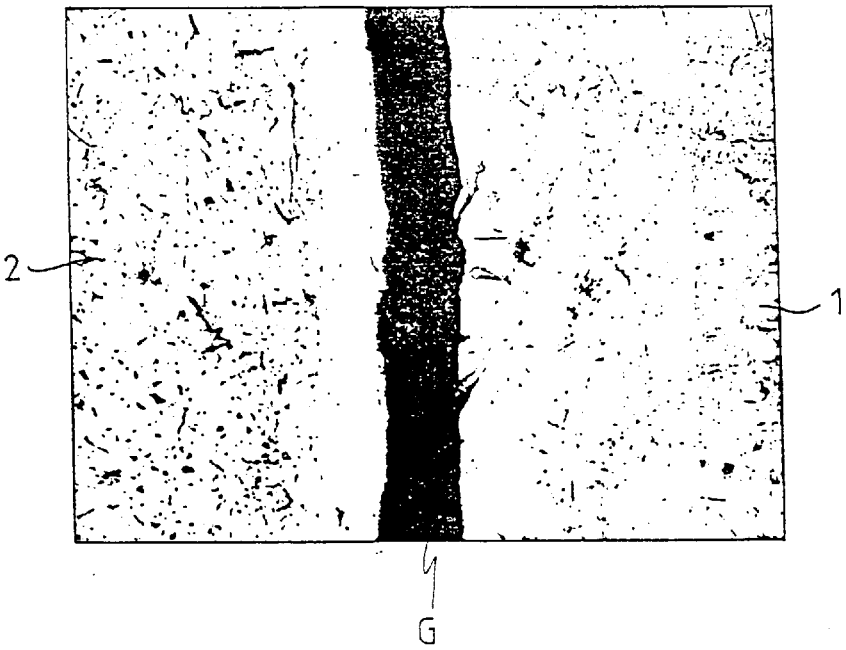
FIG. 11 prior art
FIG. 11 is a photograph showing a plane view of a gap at a joint of a prior art bimetallic coin comparable to that of the second embodiment of this invention.
Figure 12:
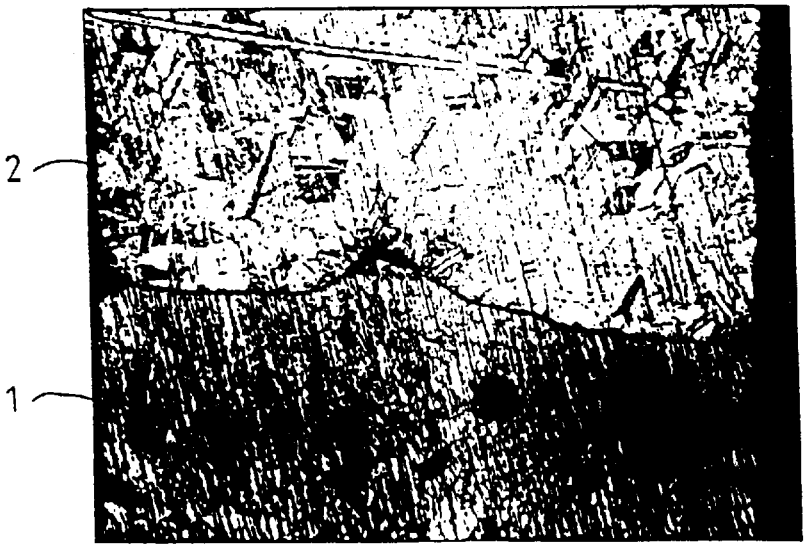
FIG. 12 prior art
FIG. 12 is a photograph showing a sectional view of a gap at a joint of a prior art bimetallic coin comparable to that of the second embodiment of this invention.

| | RESULTS | |
|---|---|---|
| | THIS INVENTION | PRIOR ART |
| outside diameters mm | 26.00 | 26.02 |
| inside diameters mm | 18.31 | 18.35 |
| thicknesses mm | 2.30 | 2.25 |
| joining forces kg · f | 310 | 280 (Canadian patent) |
| gap at the joint mm | 0.05–0.08 (FIG. 9) | 0.15–0.70 (European patent: FIG. 11) |

As can be seen from above table, it is found that this invention has the joining force higher than the Canadian patent by 30 kg·f, and the gap at the joint narrower than the European patent by 0.10 mm–0.62 mm.

THIRD EMBODIMENT

Figure 13:
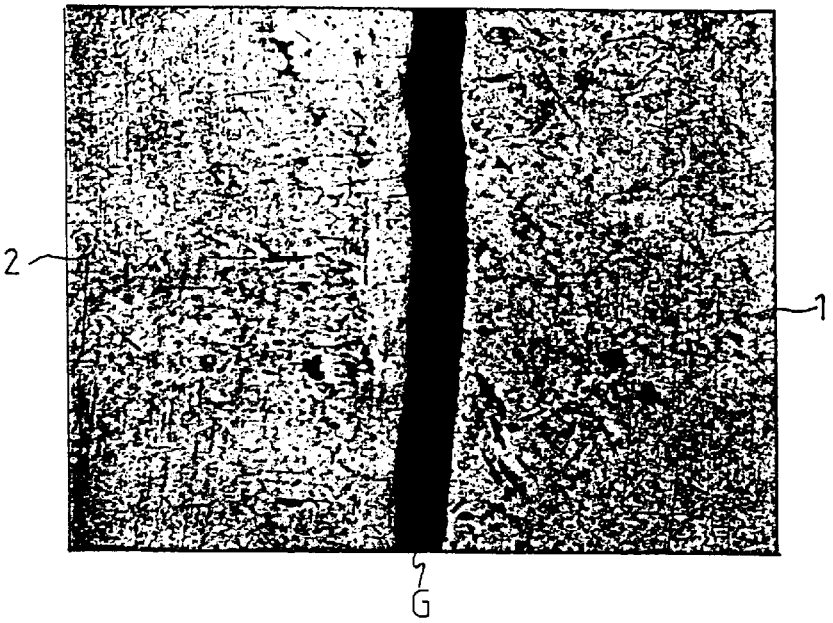
FIG. 13 is a photograph showing a plane view of a gap at a joint of a bimetallic coin formed in accordance with a third embodiment of this invention.
Figure 14:
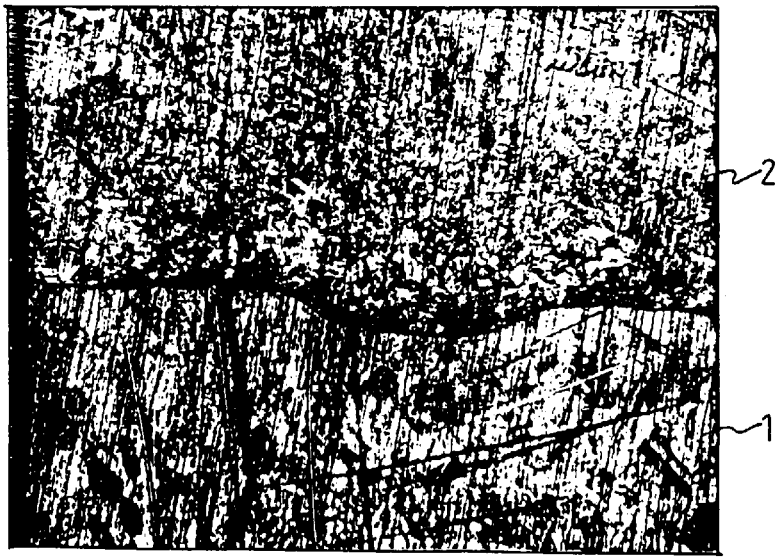
FIG. 14 is a photograph showing a sectional view of a joint of a bimetallic coin formed in accordance with the third embodiment of this invention.

The ring formed through blanking, annealing, and pickling to have a thickness of 2.0 mm, an outside diameter of 27.87 mm, and an inside diameter of 18.85 mm and the insert with the rims and the ridge thereon formed through blanking, annealing, and pickling to have a thickness of 2.02 mm and a diameter of 18.94 mm, have been joined together, and a desired design has been minted thereon (FIGS. 13 and 14).

The insert has been formed to have the ridge 3 on the circumference thereof with a height of 0.2 mm and a width of 0.8 mm, and the rims on both sides thereof with a height of 2.50 mm.

Bimetallic coins formed in accordance with another embodiment of this invention and the prior art(the European patent:see FIGS. 15 and 16) are compared as shown in TABLE 3 below.

TABLE 3

Figure 15:
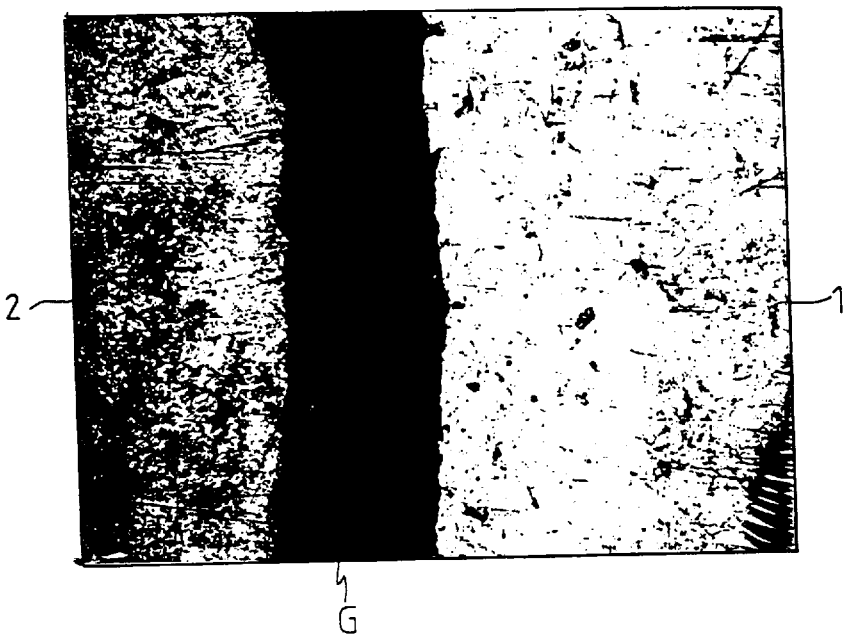
FIG. 15 prior art
FIG. 15 is a photograph showing a plane view of a gap at a joint of a prior art bimetallic coin comparable to that of the third embodiment of this invention.
Figure 16:
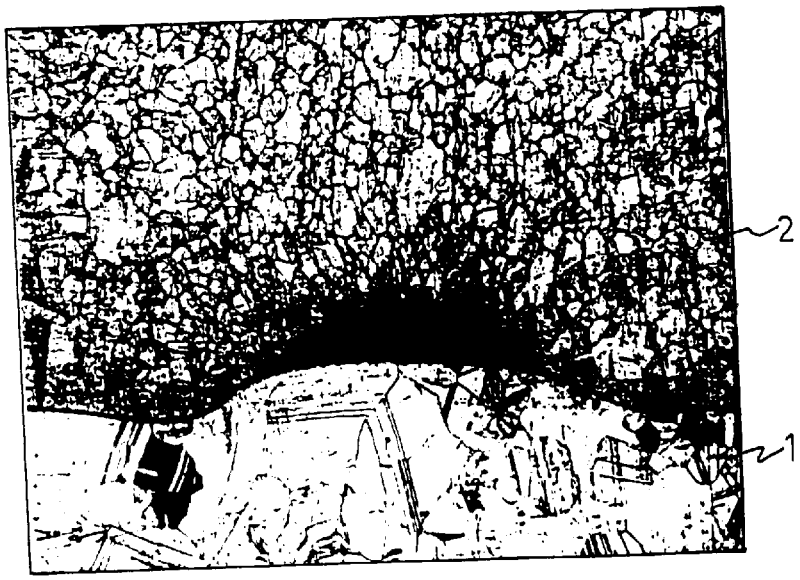
FIG. 16 prior art
FIG. 16 is a photograph showing a sectional view of a gap at a joint of a prior art bimetallic coin comparable to that of the third embodiment of this invention.

| | RESULTS | |
|---|---|---|
| | THIS INVENTION | PRIOR ART |
| outside diameters mm | 28.00 | 28.02 |
| inside diameters mm | 19.00 | 19.05 |
| thicknesses mm | 2.55 | 2.50 |
| joining forces kg · f | 330 | 290 (Canadian patent) |
| gap at the joint mm | 0.03–0.08 (FIG. 13) | 0.15–0.80 (European patent: FIG. 15) |

As can be seen from above table, it is found that this invention has the joining force higher than the Canadian patent by 40 kg·f, and the gap at the joint narrower than the European patent by 0.12 mm–0.72 mm.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A bimetallic coin prepared by a process comprising the steps of:

forming a ring having a central bore and rectangular cross-section by subjecting a first metal element to blanking, annealing, and pickling;

forming an insert, having two sides and a thickened rim on each of said sides, by subjecting a second metal element to blanking and annealing;

forming an annular ridge around the circumferential surface of the insert;

pickling the insert;

inserting the insert into said central bore; and joining the ring and the insert by causing plastic metal flow of the ridge of the insert into a plain cylindrical inner circumferential surface of the ring defining said central bore through blanking the insert;

wherein the ridge is harder than the ring.

* * * * *